US005243804A

United States Patent [19]

Therrien et al.

[11] Patent Number: 5,243,804

[45] Date of Patent: Sep. 14, 1993

[54] FLOOR WITH CARRIER SLATS MADE FROM SURFACE SLATS

[75] Inventors: Martial Therrien, Rosemère; Réjean Rhéaume, Laprairie, both of Canada

[73] Assignees: Jean-François Clement; François Briere, Montreal, Canada

[21] Appl. No.: 672,186

[22] Filed: Mar. 20, 1991

[51] Int. Cl.[5] ..... E04C 2/42; E04F 19/10

[52] U.S. Cl. ..... 52/664; 52/667; 52/668; 52/177; 15/215

[58] Field of Search ..... 52/664, 666, 667, 668, 52/669, 177, 180, 181; 15/215, 216, 217

[56] References Cited

U.S. PATENT DOCUMENTS

| | | | |
|---|---|---|---|
| 3,044,586 | 7/1962 | Cassels | 52/669 |
| 3,383,822 | 5/1968 | Viehmann et al. | 52/667 |
| 3,420,015 | 1/1969 | Costanzo, Jr. . | |
| 3,783,471 | 1/1974 | McGeary et al. . | |
| 3,808,628 | 5/1974 | Betts . | |
| 3,862,464 | 1/1975 | Arens . | |
| 3,864,887 | 2/1975 | Arens . | |
| 3,913,291 | 10/1975 | Dulien et al. | 52/403 |
| 3,943,675 | 3/1976 | Wyss . | |
| 4,182,093 | 1/1980 | Porumbescu . | |
| 4,226,064 | 10/1980 | Kraayenhof . | |
| 4,522,009 | 6/1985 | Fingerson | 52/177 X |
| 4,928,471 | 5/1990 | Bartley . | |

FOREIGN PATENT DOCUMENTS

| | | | |
|---|---|---|---|
| 713747 | 7/1965 | Canada . | |
| 989134 | 5/1976 | Canada . | |
| 1214005 | 11/1986 | Canada . | |
| 3210042 | 9/1983 | Fed. Rep. of Germany | 52/666 |

*Primary Examiner*—Carl D. Friedman
*Assistant Examiner*—Robert J. Canfield
*Attorney, Agent, or Firm*—Robic

[57] ABSTRACT

A grating-like floor comprises a plurality of slats each having a flat upper surface and a longitudinally extending substantially perpendicular bottom projection. The bottom projection may be barbed and have grooves provided in the projection of the plurality of slats where they intersect in a transverse fashion, such that a series of upright slats plug into at least two slats turned upside down in order to form the floor. Except for the grooves, the same slat is used for forming the floor surface and for forming a base of the floor.

15 Claims, 3 Drawing Sheets

FLOOR WITH CARRIER SLATS MADE FROM SURFACE SLATS

BACKGROUND OF THE INVENTION

This invention relates to a floor made up of slats having front surface and opposite thereto at least one serrated or anchoring projection. More particularly, the invention is directed to a floor for mats and sole scrapping. The floor comprises solely a number of the slats interlocked and anchored.

DESCRIPTION OF RELATED ART

Various entrance mats are known. For instance in Canadian patent 1,214,008 dated Nov. 13, 1986 as invented by DUPONT and LAURENT, there is disclosed a tile having a flat imperforated base with a top surface and a shape defined by straight sides, with means to removably connect the tile to adjacent identical tiles, such as a slot tappering near its surface and a corresponding tongue.

Canadian patent 989,134 to Hassman dated May 18, 1976, is discloses a flooring member having a horizontal top portion and a substantially flat upper surface suitable for forming a portion of the floor and at least one relatively flat vertically extending support portion to be used in combination with a tie bar.

Canadian patent 713,747 to Glader dated Jul. 20, 1965, discloses a disassemblable grid interconnected with threaded rods and fastened with nuts.

U.S. Pat. No. 3,943,675 to Wyss dated Mar. 16, 1987 discloses a disassemblable grating assembly comprising a plurality of inverted T-shaped cross-section pieces, each having a plurality of slots in the upper flange. The slots have convexly curved central walls. A plurality of transverse profile bars have curved lower flange portion that engage in the slot curvature when assembled, the latter is implemented by bending the pieces to open the slot malt and facilitate the bar insertion.

U.S. Pat. No. 3,864,887 to Arens dated Feb. 11, 1976 discloses a disassemblable slidable grating consisting of space parallel rails fastened to transverse carrier bars, each rail having a lower exact profile portion that slides into a similar notch in a bar and an upper portion which extends at an acute angle of the bar.

And finally, in U.S. Pat. No. 3,420,015 to Costenzo dated Jan. 7, 1969 there is disclosed a disassemblable grating which is T-shaped, the end portion of which is split into two halves to engage the slot of a longitudinal piece.

SUMMARY OF THE INVENTION

Broadly stated, the invention is directed to a floor comprising a plurality of slats having an upper surface, a bottom surface and a longitudinally extending, substantially perpendicular bottom projection, the cross-sectional profile of the slats being identical, at least two of the slats being used upside down as base carrier members and a remainder of the plurality of slats being sued as surface slats, a plurality of groove means provided in the projection of the plurality of slats where the base carrier members intersect transversely the surface slats with the bottom surface contacting the projection, and anchoring ridge means provided on each projection for engaging the plurality of groove means. In this way when at least two of the plurality of slats are laid with their upper surface down, in parallel and spaced apart (acting as carrier or base members), the remainder of the plurality of slats (surface slats) can be laid transversely on top such that a floor surface is made from the upper surface of the surface slats juxtaposed one another.

By "juxtaposed" is meant throughout this specification, including the disclosure and claims placed side by side, whether without or preferably with a space between adjacent slats.

One of the advantages of such floor slats is that one model can be extruded, and the toothed projection conducted on part thereof, thus these slats become the sole component of the floor mat.

This is a real manufacturing and commercial advantage over the prior art.

In a particular embodiment, the invention is directed to a floor wherein the slats have each a front surface and a rear surface and opposite said front surface on said rear surface, at least one projection running lengthwise along about the longitudinal axis of said slat, said slat thereby producing a cross-section which is substantially T-shaped, said projection being serrated by a plurality of parallel and equally spaced lines of serrations, disposed parallel to said rear surface.

BRIEF DESCRIPTION OF THE DRAWINGS

Referring now to the drawings which illustrate particular embodiments of the invention, FIG. 4, is a floor slat having device to securely hold a surfacing element.

DETAILED DESCRIPTION OF A PREFERRED EMBODIMENT

Figure 1:
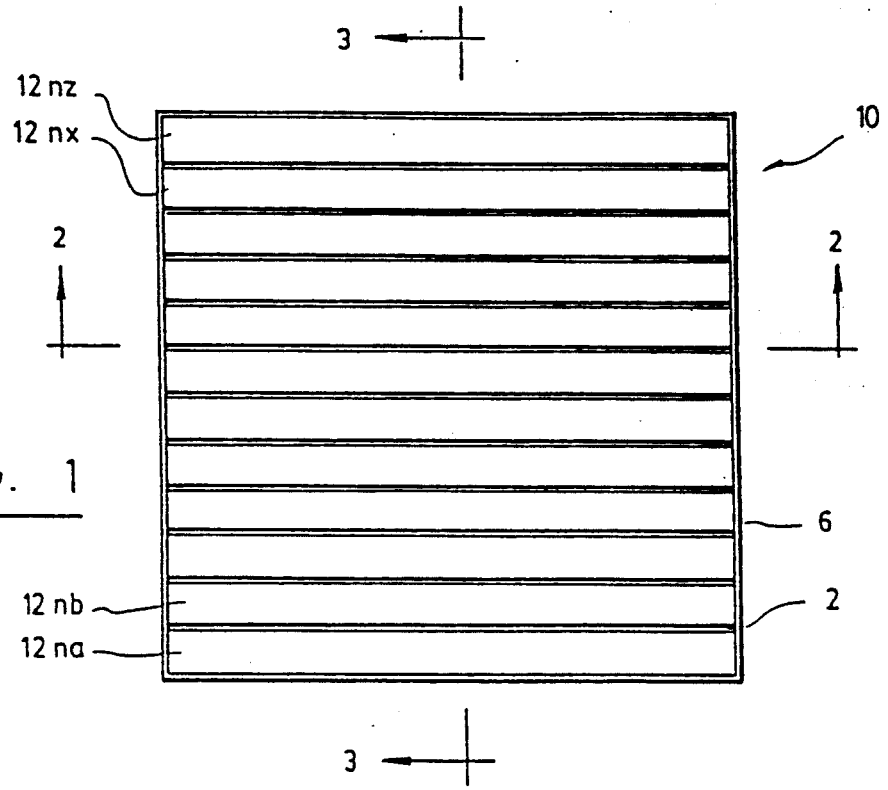
FIG. 1 is a top view of an entrance grating.

Referring now to FIG. 1, a floor mat (10) is shown being made up of a plurality of floor slats ($12n_a$, ($12n_b$), . . . ($12n_y$), ($12n_z$).

Figure 4:
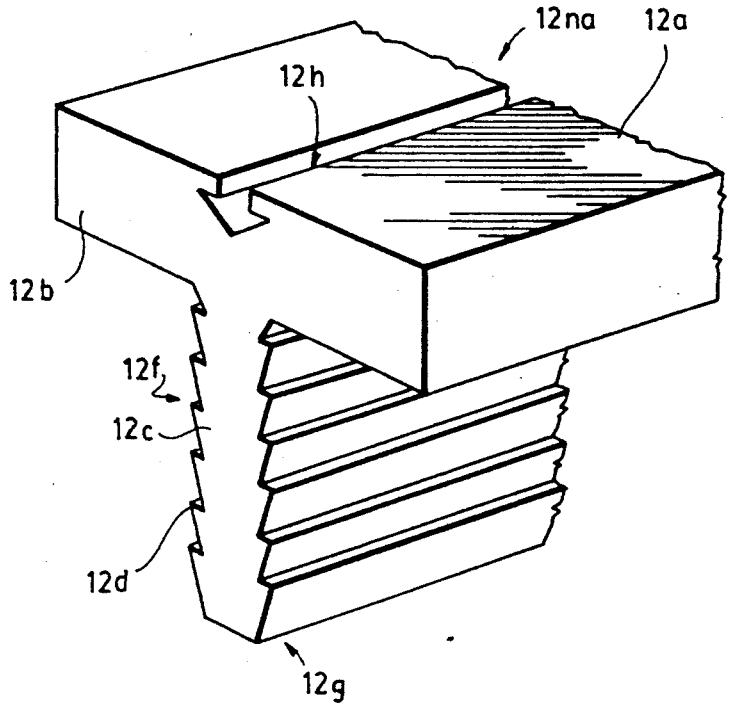
FIG. 4 is a partial oblique view of a floor slat.

As shown in FIG. 4, a floor slat ($12n_a$) has a front surface (12*a*) and opposite said front surface a rear surface (12*b*) having at least one projection (12*c*) running lengthwise of the floor slat and extending substantially therefrom. The projection (12*c*) defines a pair of lateral surfaces (12*f*) and (12*g*). The projections such as (12*c*) are serrated or provided with anchoring devices or means such as the serrated portion (12*d*). Also, as shown at (12*h*), the slat may be provided on its front surface with a groove to securely hold a surfacing element. Such a groove may for instance have an arrow-shaped cross-section tappering near the front surface.

Figure 2:
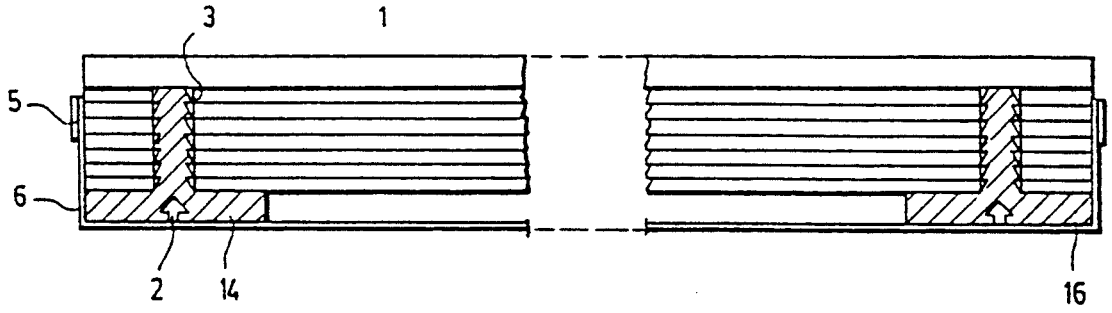
FIG. 2 is a cross-sectional view taken along line 2—2 of FIG. 1.
Figure 3:
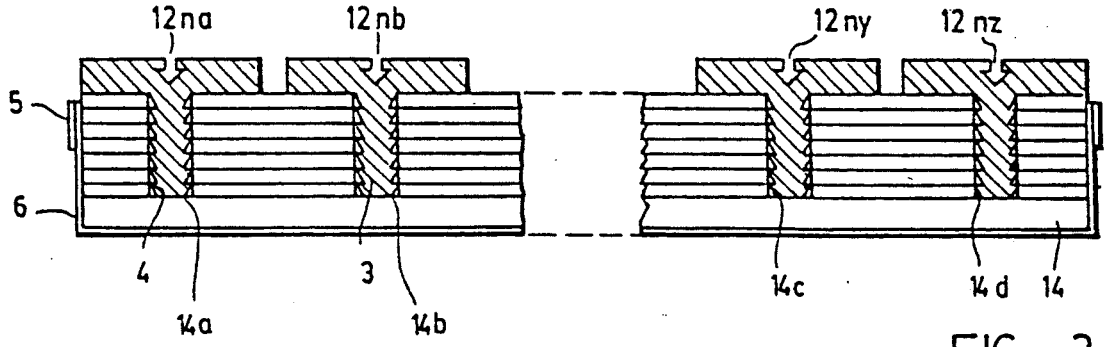
FIG. 3 is another cross-sectional view, taken along line 3—3 of FIG. 1.

As shown in FIGS. 2 and 3, at least two of the slats such as (14) and (16) have toothed projections defining along said projection grooves extending across the projection and being complementary to said at least one projection. For instance, as shown in FIG. 3, the grooves such as (14*a*), (14*b*), (14*c*) and (14*d*) have in dimensions about the same thickness and the same depth as of the projection (12*c*), thereby two floor slats such as (14) and (16) could be placed parallel and upside down as shown in FIG. 2, at some distance one from the other, to receive a plurality of juxtaposed floor slats such as ($12n_a$). $12n_b$). FIG. 3, thus the projection(s) of the floor slats defining the front surface are locked in said grooves such as (14*a*), (14*b*), (14*c*) and (14*d*). The serrated projection (12*d*) (see FIG. 4) running lengthwise along the two lateral surfaces of the projection (12*c*), anchoringly engage the walls of the toothed projections adjacent the grooves.

The slats (12), (14) and (16) may be held within a water containing base pan (6) having a reinforced rim (5).

Figure 5:
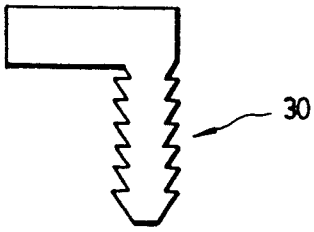
FIG. 5 is a cross-sectional view of a floor slat having an L-shaped cross-section.
Figure 6:
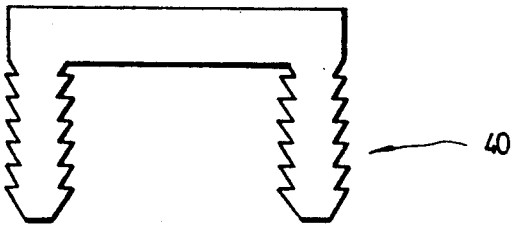
FIG. 6 is a cross-sectional view of a floor slat having a U-shaped cross-section.

The floor slats need not be of the type shown in FIG. 4 i.e. a single projection about the longitudinal axis of the slot defining a T-shaped cross-section, wherein said projections have lateral flat surfaces that are substantially parallel with respect to one another and substantially perpendicular to the top surface of the slat but may also be as shown in FIGS. 5 and 6. They may also be M-shaped.

In FIG. 5, the projection is running lengthwise of the floor slat but near one of its lateral edge, as shown at (30) defining a L-shaped cross-section.

In FIG. 6, the floor slat is provided with two projections each running lengthwise of the floor slat (40), the projections being near the lateral edges of the floor slat defining a U-shaped cross-section. It should be noted again that the floor slat may be provided with a plurality of projections if desired, and that FIGS. 4, 5 and 6 illustrate but some of the preferred embodiments only. With such construction the juxtaposed slats are easily snapped on. The projection can take various shapes and need not have lateral surfaces that are substantially parallel and perpendicular to the top surface as shown in FIG. 4, but can also be tapered thereby defining a trapezoidal cross-section with slightly inclined lateral surfaces.

In a preferred embodiment the serrated projections are linearly disposed into a plurality of linear surfaces of said projection.

Figure 8:
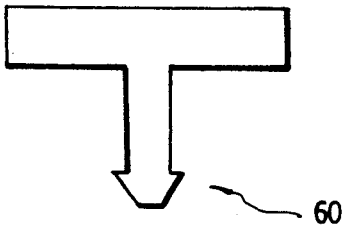
FIG. 8 is a cross-sectional view of a floor slat having a truncated V-shaped cross-section, FIG. 9, adjacent

As shown in FIG. 8, the slat may have a single projection which is a truncated V-shaped in cross-section to define an arrow-like slot.

The grooves need not be as shown in FIGS. 2 and 3 but may take other shapes, for instance they may be complementary in shape to the projection or projections.

Figure 7:
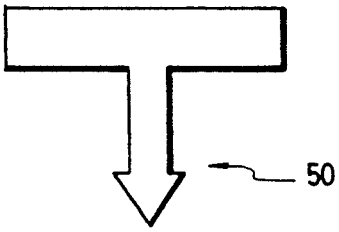
FIG. 7 is a cross-sectional view of a floor slat having an arrow-shaped cross-section.

It should be noted that the floor slats need not be serrated, although serrated projections are preferred, for instance, the anchoring device may be as shown in FIGS. 7 at (50) and FIG. 8 at (60), or the device may be projections spines, or projection, etc.

In a preferred embodiment the grooves have a smooth even surface and the projections are serrated and anchor in the surface of the grooves.

Figure 9:
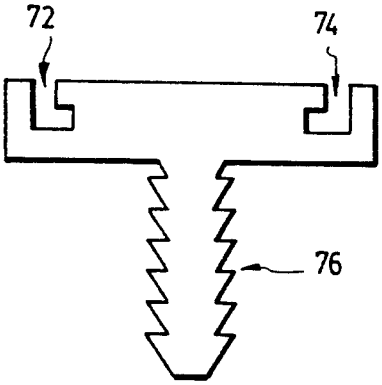
Figure 10:
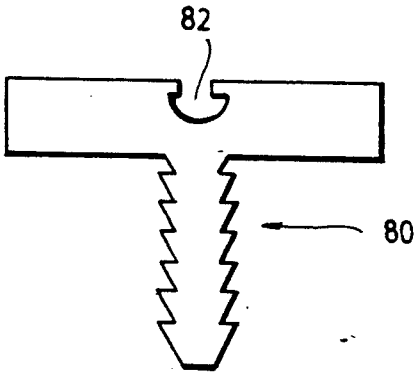
FIG. 10 is a floor slat having another device to hold a surfacing element.

The device to securely hold a surfacing element may be, as shown in FIG. 9, two L-paths traced out symmetrically about the longitudinal axis of the slat, (72), (74), and the extending arm of each of said L-shaped paths being in a same plane and facing the symmetrical axis. The device may be as shown in FIG. 4, wherein on said front surface, said device is a path traced out along the longitudinal axis of the slat, said path having an arrow-shaped cross-section tappering near the front surface or as shown in FIG. 10 at (80), having a device to securely hold a surfacing element such as a device which has a path traced out along the longitudinal axis of the slat, said path having a cross-section of an inverted stud having a semicircular head similar to but longer than the inverted stud shown in FIG. 10 at (82) to replace element (80).

Any other device to secure a surfacing element is herein contemplated.

The slat can be easily extruded using polymeric materials as is well known for instance PVC, or may be laminated with metals aluminum for instance. The slats may be resilient using SBR for instance, wood may be used if desired. Still another preferred embodiment the slats that are juxtaposed have on their front surface are anti-skid using anti-skid materials, sands, anti-skid bords, and other non-polished surfaces.

Also, surfacing elements such as carpets, ceramic or tiles such as vinyl tiles may be used as surfacing elements over the slats.

What is claimed is:

1. A floor comprising:

a plurality of slats having an upper surface, a bottom surface and a longitudinally extending, substantially perpendicular bottom projection, said slats having an identical cross-sectional profile, at least two of the slats being used upside down as base carrier members and a remainder of said plurality of slats being sued as surface slats;

whereby said at least two of said plurality of slats are laid with their upper surface down, in parallel and spaced apart relationship, and the remainder of said plurality of slats are laid transversely on top of said at least two slats such that a floor surface is made from the upper surface of the surface slats juxtaposed one another;

a plurality of groove means provided in said projection of said plurality of slats where said base carrier members intersect transversely said surface slats with each said bottom surface contacting a said projection; and anchoring ridge means provided on each said projection for engaging said plurality of groove means.

2. A floor as defined in claim 1, wherein said slats are provided on their upper surface with a device to securely hold a surfacing element.

3. A floor as defined in claim 2, wherein on said upper surface, said device is a path traced out along the longitudinal axis of the slat, said path having an arrow-shaped cross-section tapering near the upper surface.

4. A floor as defined in claim 2, wherein on said upper surface, said device has a path traced out along the longitudinal axis of the slat, said path having a cross-section of an inverted stud having a semicircular head.

5. A floor as defined in claim 2, wherein on said upper surface, said device has two paths traced out symmetrically disposed about the longitudinal axis of the slat and the extending arm of each of said L-shaped path being in a same plane and facing the symmetrical axis.

6. A floor as defined in claim 1, wherein said groove means have a smooth even surface and said anchoring means comprise a serrated surface on said projections.

7. A floor as defined in claim 1, wherein said plurality of groove means are provided entirely in said projection of said at least two of the slats and have a depth equal to a height of said projection.

8. A floor as defined in claim 1, wherein said anchoring ridge means comprise at least one barb-like ridge extending along each side of said projection.

9. A floor as defined in claim 1, wherein said slats have a T-shaped cross-section.

10. A floor as defined in claim 1, wherein said slats have an L-shaped cross-section.

11. A floor slat as defined in claim 1, wherein said slats have an additional projection and have a U-shaped cross-section.

12. A floor as defined in claim 1, wherein said projection is rectangular in cross-section and has lateral flat surfaces substantially parallel with respect to one another and substantially perpendicular to said upper surface.

13. A floor as defined in claim 1, wherein said slats are extruded.

14. A floor as defined in claim 1, wherein said juxtaposed slats are spaced.

15. A floor as defined in claim 1, wherein said slats are resilient.

* * * * *